US011235904B2

(12) United States Patent
Whitehurst

(10) Patent No.: US 11,235,904 B2
(45) Date of Patent: Feb. 1, 2022

(54) PACKAGING INSERT

(71) Applicant: Burgopak Limited, London (GB)

(72) Inventor: Dane Whitehurst, London (GB)

(73) Assignee: BURGOPAK LIMITED, London (GB)

( * ) Notice: Subject to any disclaimer, the term of this patent is extended or adjusted under 35 U.S.C. 154(b) by 280 days.

(21) Appl. No.: 16/672,272

(22) Filed: Nov. 1, 2019

(65) Prior Publication Data

US 2020/0290766 A1 Sep. 17, 2020

(30) Foreign Application Priority Data

Mar. 13, 2019 (GB) ..... 1903460

(51) Int. Cl.
*B65D 5/38* (2006.01)
*B65D 5/72* (2006.01)

(52) U.S. Cl.
CPC ..... *B65D 5/38* (2013.01); *B65D 5/728* (2013.01)

(58) Field of Classification Search
CPC ..... B65D 27/00; B65D 27/02; B65D 27/04; B65D 23/14; B65D 27/14; B65D 27/30; B65D 27/38; B65D 79/00; B65D 5/5213; B65D 27/26; B65D 27/34
USPC ..... 229/68.1, 69–76, 79–82, 300–316, 92.8, 229/87.05, 927, 928
See application file for complete search history.

(56) References Cited

U.S. PATENT DOCUMENTS 1,295,833 A * 3/1919 Allen ..... B65D 27/08 229/72
1,405,002 A * 1/1922 Rhodes ..... B65D 5/68 229/125.21
1,684,105 A * 9/1928 Olm ..... B65D 27/08 229/72
1,895,486 A * 1/1933 Elmerg ..... B65D 27/08 229/72
2,055,716 A * 9/1936 Berkowitz ..... B65D 27/04 229/72
3,498,446 A * 3/1970 Lafreniere ..... B65D 5/20 229/162.6

(Continued)

FOREIGN PATENT DOCUMENTS

ES 1068152 U * 9/2008 ..... B65D 27/00
GB 2490524 A 11/2012

(Continued)

OTHER PUBLICATIONS

Canadian Intellectual Property Office, Examination Search Report for Application 3,060,799, dated Jan. 27, 2021, 5 pages.

*Primary Examiner* — Anthony D Stashick
*Assistant Examiner* — Prince Pal
(74) *Attorney, Agent, or Firm* — Stoel Rives LLP

(57) ABSTRACT

The disclosure relates to a package comprising a sleeve and an insert received in the sleeve, where the insert is movable between a retracted and extended configuration. The insert includes a carrier having a passage, and a band extending around a wall of the carrier and through the passage. The insert further includes a first member located within the passage when the insert is in the retracted configuration, the first member being attached to the band, wherein at least a portion of the band that overlies the wall is exposed for attachment to the sleeve of the package at a second coupling location on the exposed portion of the band.

20 Claims, 8 Drawing Sheets

(56) References Cited

U.S. PATENT DOCUMENTS 4,763,789 A * 8/1988 Questel ..... B42D 15/00 206/454
4,790,120 A * 12/1988 Manduley ..... H01R 12/7076 206/706
6,024,278 A * 2/2000 Martin ..... B42D 15/08 229/71
6,237,265 B1 5/2001 Crowell
6,557,700 B1 * 5/2003 Wharton ..... B65D 5/38 206/308.1
7,159,717 B2 * 1/2007 Aldridge ..... B65D 5/009 206/449
7,451,909 B2 * 11/2008 Sexton ..... B42D 15/045 229/128
8,256,194 B2 * 9/2012 Brown ..... B65D 27/00 53/460
9,290,033 B2 * 3/2016 Russell ..... B31B 70/00
2003/0230626 A1 * 12/2003 Rones ..... B65D 27/08 229/300
2006/0278687 A1 * 12/2006 Sexton ..... B42D 15/045 229/92.8
2011/0139864 A1 6/2011 Wipf
2012/0152766 A1 * 6/2012 Mazurek ..... B65D 5/38 206/1.5
2020/0290769 A1 * 9/2020 Uyeda ..... B65D 27/14

FOREIGN PATENT DOCUMENTS

WO 2007034227 A2 3/2007
WO 2007083151 A1 7/2007

* cited by examiner

PACKAGING INSERT

RELATED APPLICATIONS

This application is a nonprovisional of and claims the benefit under 35 U.S.C. § 119(a) of GB1903460.2, filed Mar. 13, 2019, entitled Packaging Insert, the disclosure of which is hereby incorporated by reference in its entirety.

TECHNICAL FIELD

The disclosure relates to a packaging insert configured to be received within a sleeve of a package, to a package comprising such an insert, and to a method of making the package.

BACKGROUND

In general, cards such as credit cards or gift cards that are delivered to a customer in the post are packaged in a paper envelope along with a letter containing any relevant information that may be required. The card is usually attached to the letter using an adhesive such as glue, before the letter is folded to the required size for the chosen envelope and inserted into the envelope ready for sending. To retrieve the card from the package, the customer simply opens the envelope and removes the letter fully from the envelope before pulling the card off of the letter paper.

It is important that letters that are mailed through the postal system are able to undergo postal processing without damage. Such processing involves significant bending and manipulation of the letter. Letters or packages that are inflexible and cannot go through such processing generally attract higher postal charges and hence are undesirable, particularly for posting of items such as bank cards, which often need to be posted in high volumes at minimum cost.

The present disclosure has been devised in view of this background, and provides an insert for a package that addresses at least some of the problems associated with the prior art.

SUMMARY

According to one aspect, the disclosure resides in an insert for a package, the package comprising a sleeve and the insert received in the sleeve. The insert is movable between retracted and extended configurations and comprises: a carrier having first and second walls defining a passage therebetween, the first wall defining an interior surface that faces the passage, and an exterior surface that faces away from the passage; a band extending around the first wall of the carrier and through the passage; and a first member located inside the passage when the insert is in the retracted configuration and attached to the band at a first coupling location inside the passage. At least a portion of the band that overlies the exterior surface of the first wall is exposed for attachment to the sleeve of the package at a second coupling location on the exposed portion of the band, such that when the insert is received in the sleeve and the band is coupled to the sleeve at the second coupling location, the carrier and the first member are movable between the retracted configuration in which the carrier and the first member are housed in the sleeve, and the extended configuration in which the carrier and the first member protrude from the sleeve, wherein the first member protrudes from the sleeve to a greater extent than the carrier in the extended configuration.

The insert of the disclosure allows for an article to be packaged in a sleeve, such as an envelope, in a secure and attractive manner. The configuration of the insert enables smooth movement of the carrier and the first member between retracted and extended configurations when the insert is integrated into a package. Advantageously, when the insert is received in a sleeve, the first member, which may optionally support an article or include text or other visual information, can be hidden from or presented to a user simply by pulling or pushing the first member into and out of the sleeve. Having a portion of the band that overlies the exterior surface of the wall exposed allows for easy integration of the insert into a package, simply by attaching the band member to an inner surface of the sleeve at a location on the exposed portion of the band member.

The first and second coupling locations may be at opposite ends of the carrier when the carrier and the first member are received in the sleeve in the retracted configuration.

The second coupling location may be at an end of the carrier adjacent to an opening of the package through which the carrier protrudes in the extended configuration, when the carrier and the first member are received in the sleeve in the retracted configuration.

The carrier may comprise first and/or second edges that join the first and second walls of the carrier.

The carrier may comprise at least one slit that extends partially along the first and/or second edge of the carrier. The carrier may comprise a first slit that extends partially along the first edge of the carrier and a second slit that extends partially along the second edge of the carrier to facilitate bending of the insert along its longitudinal axis.

The carrier may comprise a foldable bonding flap for coupling the first and second walls of the carrier. The bonding flap may be attached to the second wall of the carrier. The bonding flap may comprise an adhesive strip. The adhesive strip may comprise a removable protective cover. The removable protective cover may be peeled away from the adhesive strip when the second wall is to be attached to the first wall.

The carrier may comprise a folded sheet. The first edge of the carrier may be defined by a fold between the first wall and the second wall and the second edge of the carrier may be defined by a fold between the second wall and the bonding flap.

The first wall of the carrier may comprise grooves that extend at least partially along edges of the band. These grooves introduce lines of weakness so that if the insert, or a package containing the insert, is bent during processing, creasing will preferentially occur along these grooves. Because the grooves are provided along the edges of the band, i.e. outboard of the band, the presence of these grooves reduces the risk of the band being damaged by such bending.

The insert may comprise a second member coupled to the carrier.

When the insert is in the extended configuration, the first member may extend beyond a second end of the carrier, and the second member may extend from a first end of the carrier opposite the second end.

The second member may be coupled to the second wall of the carrier. The second member may be continuous with the second wall of the carrier.

The combined length of the carrier and the second member may be substantially the same as the length of a sleeve into which the insert is to be provided in use. In the case where the insert is provided in a sleeve in the form of an envelope, the second member helps to maintain the correct position of the components of the insert in the envelope.

That is, the second member guards against the first member being pushed further into the envelope than is necessary or ideal.

An end of the second member may comprise a lip arranged to drive an article out of the sleeve when the carrier and the first member are moved from the retracted configuration to the extended configuration.

The second member may comprise a window arranged to align with a window of the sleeve when the insert is received in the sleeve in use. This allows information included on a document provided in the sleeve, for example a customer name and address when the sleeve is an envelope, to be viewed from outside of the sleeve.

The band may be attached to the first member, and/or attachable to the sleeve, by means of an adhesive. The band may comprise one or more adhesive strips for attaching the band to the first member and/or the sleeve. The one or more adhesive strips may comprise a removable protective cover. The removable protective cover prevents damage to and/or contamination of the adhesive strip before the adhesive strip is required for use.

One or more of the carrier, the first member and the second member may be substantially planar. In this way, the thickness or depth of a package including an insert of the preceding claims may advantageously be kept to a minimum.

The first member may comprise a foldable pull tab. The first member may comprise support formations for supporting an article. The support formations may be arranged for supporting a gift card, a bank card or any other type of card.

The carrier may be configured to restrain the band against lateral movement, i.e. where the carrier is planar, against movement of the band within the plane of the carrier. For example, the carrier may include one or more features, which may be integral with the carrier or attached to the carrier, that restrain lateral movement of the band away from its intended position on the carrier.

The carrier may comprise a pull tab receiving portion for receiving a folded pull tab of the first member, optionally in the form of a cut-out. In this way, the pull tab of the first member can advantageously be accommodated in the pull tab receiving portion in an assembled package.

One or more of the carrier, the first member and the second member may be formed of a flexible material. In this way, the insert may be accommodated in packages which may undergo some level of bending, without being damaged and the performance and operation of the insert being compromised.

One or more of the carrier, the first member and the second member may be formed of cardboard. One or more of the carrier, the first member and the second member may be formed from a sheet having a thickness between about 0.005 and about 2 mm, preferably between about 0.01 and about 0.5 mm, and most preferably between about 0.05 and about 0.2 mm.

The insert may be a flexible insert and the package may be a flexible package.

The first member may be substantially planar. The first and second walls of the carrier may be substantially planar. When the insert is in the retracted configuration, the first member may be sandwiched between the first and second walls of the carrier, and may be substantially in contact with the band and the second wall of the carrier.

According to another aspect, the disclosure resides in a package comprising an insert as described above, and a sleeve. The insert is arranged in the sleeve, and the band of the insert is coupled to the sleeve at the second coupling location on the exposed portion of the band, such that the carrier and the first member of the insert are movable between a retracted configuration in which the carrier and the first member are housed in the sleeve, and an extended configuration in which the carrier and the first member protrude from the sleeve. The first member protrudes from the sleeve to a greater extent than the carrier in the extended configuration.

The package may comprise a first article supported by the first member, wherein the first article is substantially hidden by the sleeve when the carrier and the first member are in the retracted configuration and is revealed when the carrier and the first member are in the extended configuration.

The package may comprise a second article supported by the second member. The second article and the second member may be arranged in the sleeve such that a lip provided at an end of the second member is configured to drive the second article out of the sleeve when the carrier and the first member are moved from the retracted configuration to the extended configuration.

The second member of the insert and the sleeve may each comprise a window, and the window of the second member of the insert and the window of the sleeve may be aligned when the insert is received in the sleeve and the carrier and the first member are in the retracted configuration, such that information provided on the second article can be viewed through the windows.

The sleeve may be an envelope. The first article may be a card such as a gift card or a bank card. The second article may be a document such as a letter.

In another aspect, the disclosure resides in a method of manufacturing a package, the package comprising an insert as claimed in any of the preceding paragraphs and a sleeve. The method comprises: arranging the insert in the sleeve; and coupling the insert to the sleeve at a second coupling location on the exposed portion of the band member, such that the carrier and the first member of the insert are movable between a retracted configuration in which the carrier and the first member are housed in the sleeve, and an extended configuration in which the carrier and the first member protrude from the sleeve, wherein the first member protrudes from the sleeve to a greater extent than the carrier in the extended configuration.

In another aspect, the disclosure resides in an insert for a package, the package comprising a sleeve and the insert received in the sleeve. The insert is movable between retracted and extended configurations. The insert comprises: a carrier having first and second walls defining a passage therebetween, the first wall defining an interior surface that faces the passage, and an exterior surface that faces away from the passage; a band extending around the first wall of the carrier and through the passage; a first member attached to the band at a first coupling location inside the passage; and a second member located outside the passage and extending beyond a first end of the carrier in a first direction, when the insert is in both the retracted and extended configurations. The first member is attached to the band such that when the insert is in the retracted configuration the first member is located inside the passage, and when the insert is in the extended configuration, the first member protrudes from a second end of the carrier opposite the first end, to extend beyond the carrier in a second direction opposite to the first direction.

In another aspect, the disclosure resides in a package comprising an insert according to the preceding paragraph and a sleeve, the insert being arranged in and coupled to the sleeve. The band of the insert may be coupled to the sleeve.

Features of one aspect may be applied, alone or in appropriate combination, to features of another aspect also. Additional aspects and advantages will be apparent from the following detailed description of preferred embodiments, which proceeds with reference to the accompanying drawings.

BRIEF DESCRIPTION OF THE DRAWINGS

Embodiments of the disclosure will now be described, by way of example only, with reference to the accompanying drawings in which.

DETAILED DESCRIPTION OF EXAMPLE EMBODIMENTS

Figure 1A:
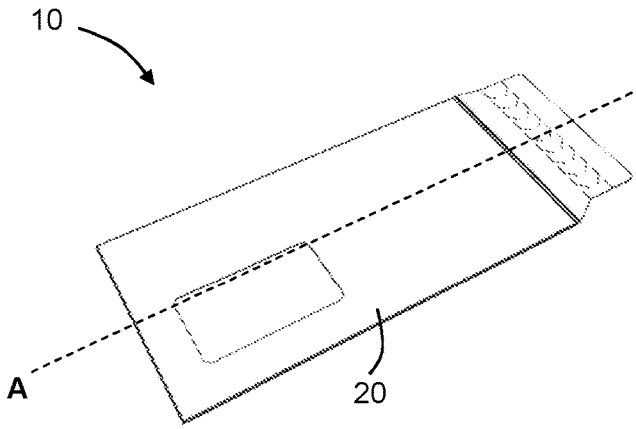
FIGS. 1A and 1B are perspective views of a package from above and below respectively, with the package in a retracted configuration.
Figure 1B:
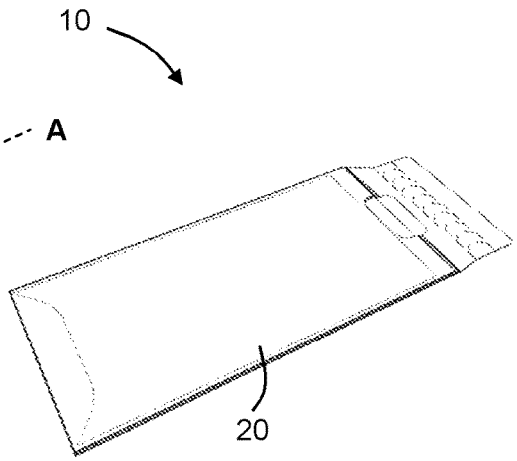

FIGS. 1A and 1B illustrate a package 10 in a closed or retracted configuration. The package 10 is generally flat and comprises a sleeve 20 in the form of an envelope, which is typically made from paper or thin card. The envelope 20 is flexible, and can be easily flexed or bent, to allow for processing of the envelope 20.

Figure 2:
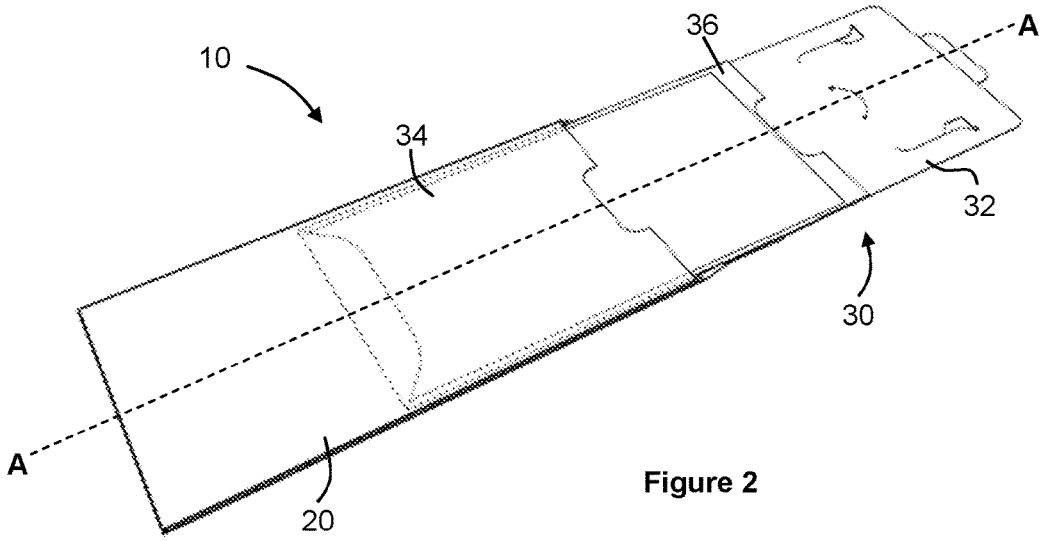
FIG. 2 is a perspective view of the package of FIGS. 1A and 1B in an extended configuration.

FIG. 2 shows the package 10 in a fully extended configuration and reveals that the package 10 also comprises an insert 30 contained within the envelope 20. The insert comprises a first member 32 that acts as a first support for supporting a first article (in this case a card such as a gift card or bank card), and an optional second member 34 that acts as a second support for supporting a second article (in this case a letter). The insert also comprises a carrier 36, and in this example the second support 34 is continuous with the carrier 36, as will be described in more detail later.

When the package 10 is in the extended configuration of FIG. 2, the first support 32 and the carrier 36 both protrude from an end of the envelope 20, with the first support 32 protruding to a greater extent than the carrier 36. In this embodiment, in the extended position, the second support 34 remains in the envelope 20.

The insert 30 is specially constructed so as to provide movability between the retracted and extended configurations described above.

Figure 3:
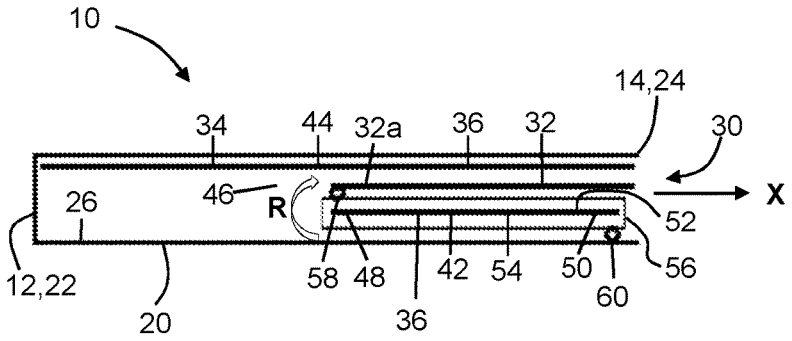
FIG. 3 is a cross-sectional view of the package of FIG. 1A along the line A-A.
Figure 4:
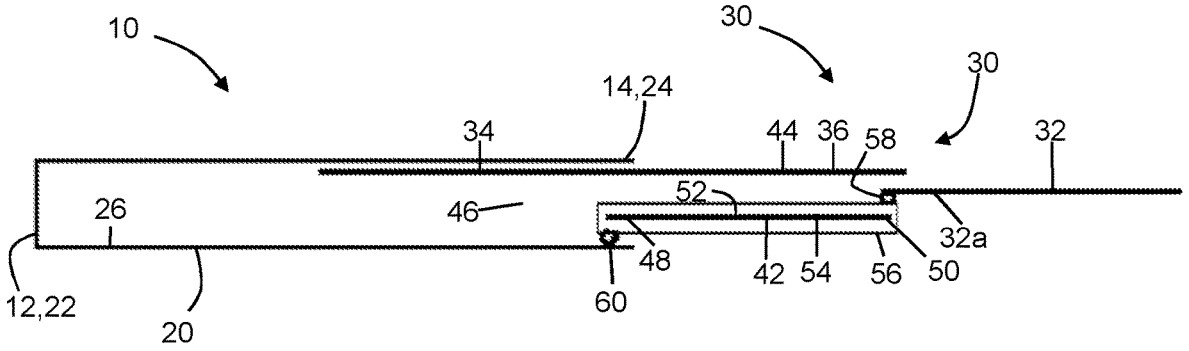
FIG. 4 is a cross-sectional view of the package of FIG. 2 along the line A-A.

FIGS. 3 and 4 show the assembled package 10, including the envelope 20 and the insert 30, in schematic cross section along the A-A of FIGS. 1A and 2. It will be appreciated that the schematic drawings of FIGS. 3 and 4 show the various components spaced apart, and the envelope 20 having a depth to accommodate the spacing. However, this is merely for illustrative purposes to show all components clearly, and it will be appreciated that in practice, the components lie directly on top of one another, such that the package 10 and envelope 20 have a very small depth.

The envelope 20 defines a first end 22 at a first end 12 of the package 10, and a second end 24 at a second end 14 of the package 10. The first end 22 of the envelope 20 is closed, while the second end is open, or openable, so as to allow the carrier 36 and first member 32 to extend out of the envelope 20.

FIG. 3 reveals that the carrier 36 comprises first and second walls 42, 44, with the second wall 44 overlying the first wall 42. A passage 46 is defined between the first and second walls 42, 44. The carrier 36 defines a first end 48 that is generally towards the first end 12 of the package 10, and a second end 50 that is generally towards the second end 14 of the package 10.

The first wall 42 of the carrier 36 comprises an internal surface 52 that faces the passage 46, and an external surface 54 that faces away from the passage 46. A band 56 encircles the first wall 42 and lies against that internal and external surfaces 52, 54, extending through the passage 46.

In the retracted configuration, the first support 32 is arranged inside the passage 46 between the first and second walls 42, 44 of the carrier 36. Inside the passage, a first end 32*a* of the first support 32 is coupled to the band 56 at a first coupling location 58, which is generally at the first end 48 of the carrier 36.

The second support 34 is integral with the second wall 44 of the carrier 36, and extends from the first end 48 of the carrier 32 to the first end 22 of the envelope 20.

Because the band 56 overlies the external surface 54 of the first wall 42 of the carrier, and because no other components of the insert 30 overlie that band 56 in the region of the second end 50 of the carrier 36, the band 56 is exposed to the envelope 20 at least at the second end 50 of the carrier 36. In the assembled package 10, an internal surface 26 at the second end 24 of the envelope 20 is coupled to the band 56 at a second coupling location 60. In this way, the first support 32 and the envelope 20 are each coupled to the band 56 at opposite ends of the carrier 36.

A user can actuate the package 10 by holding the envelope 20 and pulling on an end of the first support 32 to move the first support 32 out of the envelope 20 in an opening direction indicated by the arrow X. Since the user is holding the envelope 20 in position, the envelope 20, and hence the second coupling location 60, remain stationary relative to the users hand. Pulling the first support 32 therefore drives rotation of the band 56 around the first wall 42 of the carrier 36 in the direction of arrow R, and simultaneously drives movement of the carrier 36 and second support 34 in the direction of arrow X.

As the user continues to pull on the first support 32, the rotation of the band 56 and movement of the various components continues, until the coupling locations 58, 60 reach the opposite ends of the carrier 36. At this point, the coupling locations 58, 60 limit movement of the band 56, because the coupling locations 58, 60 cannot pass over the end of the first wall 42 of the carrier 36. The package 10 is now in the extended configuration of FIG. 4, in which the second coupling location 60 is located generally at the first end 48 of the carrier 36, and the first coupling location 58 is located generally at the second end 50 of the carrier 36. In this way, the carrier 36 extends beyond the second coupling location 60, and hence beyond the second end 24 of the envelope 20, in the direction A, while the first support 32 extends beyond the first coupling location 58, and hence beyond the second end 50 of the carrier 36, in the direction of arrow A.

To close the package 10 back into the retracted configuration, the user holds the envelope 20 and pushes the first support 32 in a closing direction opposite to arrow A. Pushing the first support 32 in this way drives the band 56 in the reverse direction, moving the carrier 36 and first support 32 back into the retracted configuration of FIG. 3.

The insert 30 is particularly well adapted for being quickly and easily retrofitted into the envelope 20. By virtue of the exposed band 56, the band 56 can be quickly and easily coupled directly to the internal surface of the envelope 20. Because the second coupling location 60 between the band 56 and the envelope 20 is arranged at the second end 50 of the carrier 36 and hence at the second end 24 of the envelope 20, the second coupling location 60 can be easily accessed to effect the coupling between the band 56 and the envelope 20.

Other features that make the insert 30 particularly suitable for retrofitting into an envelope 20 to produce the package 10 will be apparent from the following, more detailed, explanation of the components of the insert 30.

Figure 5:
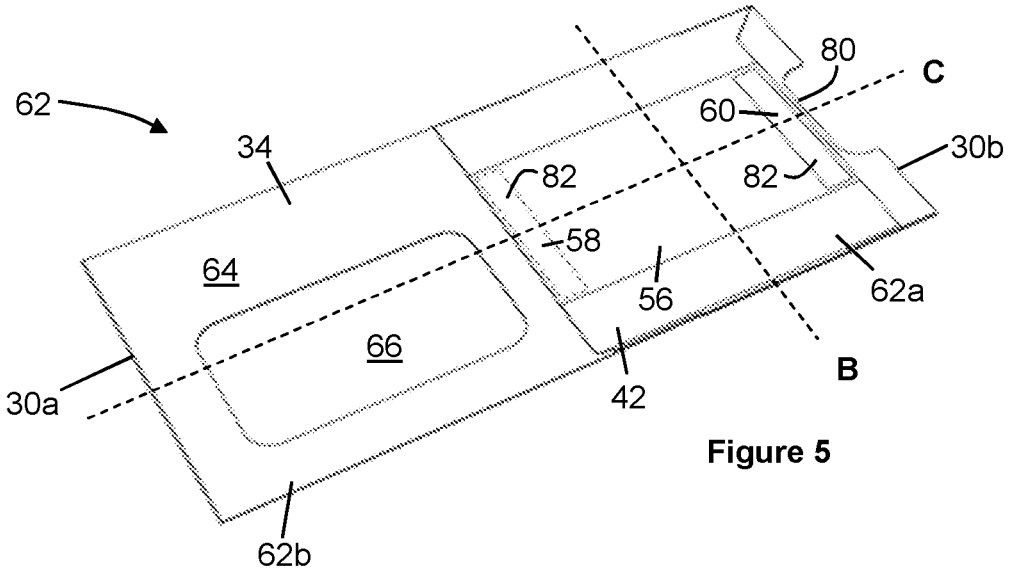
FIG. 5 is perspective view of an insert forming part of the package of FIG. 1A.
Figure 6:
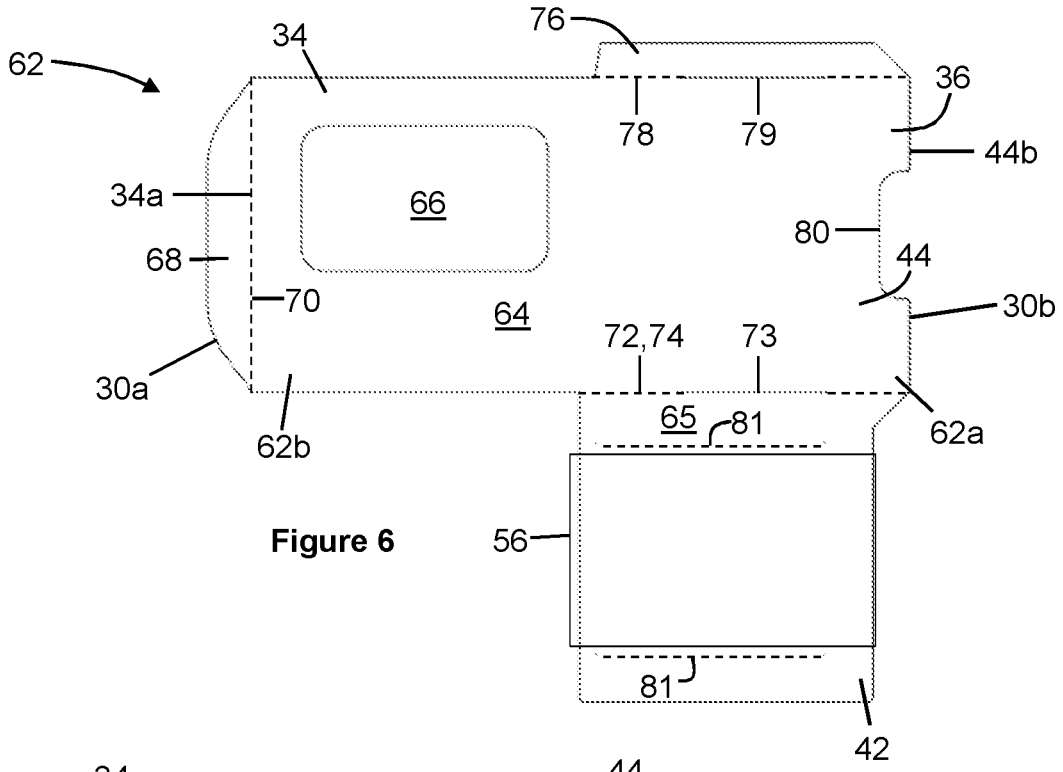
FIG. 6 is a plan view of a component forming part of the insert of FIG. 5, in an unfolded configuration.
Figure 7:
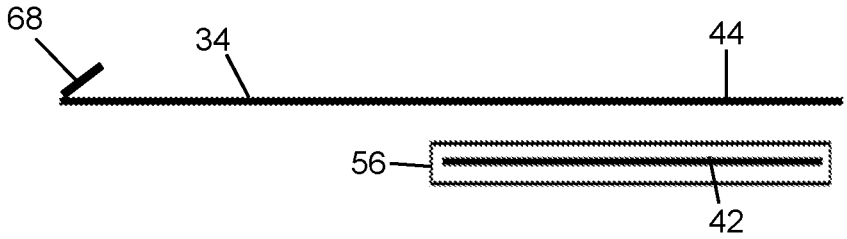
FIG. 7 is a cross-section view of the component of FIG. 6, in a folded configuration.

FIGS. 5 to 7 show an insert component 62 that comprises a carrier portion 62*a* that defines the carrier 36 and a support portion 62*b* that defines the second support 34, the carrier portion 62*a* and support portion 62*b* being formed together as a single integral component. The band 56 is also shown in place around the first wall 42 of the carrier 36.

The component 62 is made from a cut or stamped sheet, shown in FIG. 6, which is folded into the arrangement shown in FIGS. 5 and 7. The sheet is made of a thin, flexible material, such as cardboard, having a thickness of between about 0.005 and about 2 mm, preferably between about 0.01 and about 0.5 mm, and most preferably between about 0.05 and about 0.2 mm. Other suitable materials include paper and plastics materials.

The second wall 44 of the carrier 36 and the second support 34 are defined by a flat panel 64. A region of the panel 64 that is generally towards a first end 30*a* of the insert 30 defines the second support 34, while a region of the panel 64 that is generally towards a second end 30*b* of the insert 30 defines the second wall 44 of the carrier 36.

The second support 34 comprises a window 66 in the panel, which is generally the size of an address label or address window in an envelope. In the assembled package, this window 66 can align with an address printed on a letter supported by the second support 34, and an address window in the envelope 20, to provide a line of sight to the address on the letter.

At a first end 34*a* of the second support 34, the second support 34 is provided with a lip 68. The lip 68 is a flat projection that extends a short distance from the end 34*a* of the second support 34. The lip 68 is joined to the panel 64 by a fold, score or crease 70.

Turning to the portion of the panel 64 that defines the second wall 44 of the support 34, the second wall 44 is joined on one side (the lower side as shown in FIG. 6) to a further flat panel 65 that defines the first wall 42 by a fold, crease or score 72. When the second wall 44 is folded over the first wall 42, as in FIG. 5, the fold 72 defines an edge 74 between the first and second walls 42, 44.

At another side (the upper side as shown in FIG. 6) of the panel 64, the panel is joined to a bonding flap 76. The bonding flap 76 is a flat projection that extends a short distance from the side of the second wall 44, and is joined to the panel 64 by a fold, score or crease 78. In the assembled package, after the second wall 44 has been folded over the first wall 42, the bonding flap 76 is folded over and bonded to the first wall 42 to secure the first wall 42 in position. To this end, the bonding flap 76 may be provided with an adhesive strip (not shown), which may have a peelable protective layer.

The respective folds 72, 78 between the second wall 44 and the first wall 42, and between the second wall 44 and the bonding flap 76, are also provided with elongate cuts or slits 73, 79, arranged generally at the center of, and extending parallel to, each fold 72, 78. These cuts facilitate bending of the insert 30 in the region of the carrier 36 about the axis B shown on FIG. 5, which would otherwise be impeded by the reinforcing effect created by the folds 72, 78.

At a second end 44*b* of the second wall 44, the panel 64 is provided with a cut-out 80 or access opening.

Considering the further panel 65 that defines the first wall 42 of the carrier 36, the further panel 65 is a generally rectangular panel that, in this example, is shorter in length than the panel 64 that defines the second wall 44 and the second support 34. In the embodiment shown the further panel 65 is approximately half the length of the panel 64.

The band 56 extends around the further panel 65 generally at the center of the panel 65. Elongate indents, creases or perforations 81 are provided on the panel 65 running generally parallel to, and slightly outboard of, the edges of the band 56. The indents provide points of weakness slightly outboard of the band, such that if the insert 30 is bent or folded about an axis C shown on FIG. 5, the insert will tend to crease along these indents 81 and hence outboard of the band 56, rather than in a region beneath the band 56. This is advantageous since creases beneath the band 56 might otherwise impede smooth running of the band 56 and hence function of the package 10.

Considering now the band 56, the band 56 is typically made of a flexible material, such as a plastics material. At the coupling locations 58, 60, the band 56 is typically coupled to the first support 32 and the envelope 20 by bonding. To this end, as shown in FIG. 5, the band 56 may be provided with a pre-applied adhesive material, such as an adhesive strip 82, at each coupling location 58, 60. The adhesive material may be provided with a peelable protective layer.

Figure 8:
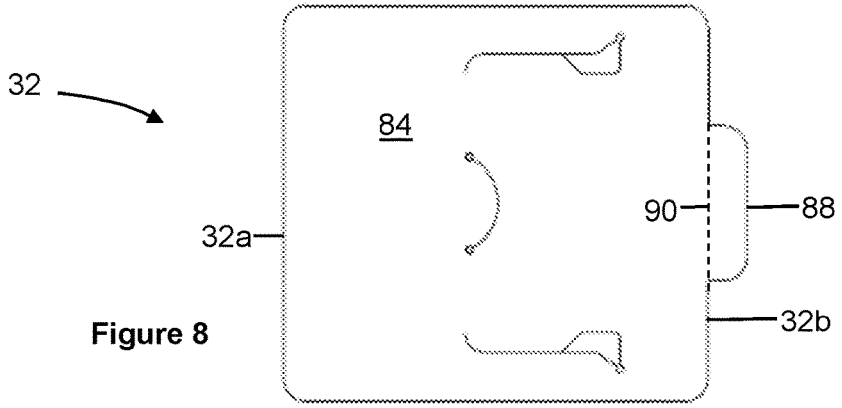
FIG. 8 is a plan view of a first member forming part of the insert of FIG. 6.

Turning now to the first support 32, FIG. 8 shows the first support 32 in isolation. The first support 32 is also defined by a flat panel that is made from a cut or stamped sheet. As with the component 62 of FIGS. 5 to 7, the sheet is made of a thin, flexible material, such as cardboard, having a thickness of between about 0.005 and about 2 mm, preferably between about 0.01 and about 0.5 mm, and most preferably between about 0.05 and about 0.2 mm. The sheet material of the first support 32 is preferably the same as the sheet material of the component 62, though in other embodiments the sheet materials may be different.

The first support 32 comprises a main panel 84 that extends between a first end 32*a* of the first support 32 and a second end 32*b* of the first support. Support formations are provided in the main panel 84, which in use support a card. In this example, the support formations are cuts or slits into which the card can be inserted such that the card is gripped by the first support 32.

At the second end 32*b* of the first support 32, the first support 32 is provided with a pull tab 88. The pull tab is a flat projection that extends a short distance from an end of the main panel 84, and is joined to the main panel 84 by a fold, score or crease 90. In this way, the pull tab can be folded over the main panel 84, or can be unfolded so as to protrude beyond the main panel 84. The pull tab 88 is of substantially the same dimensions as the cut-out 80 on the second wall 44 of the carrier 36. In this way, in the assembled package 10, when the pull tab 84 is folded over, it can be accommodated in the cut out 80.

Referring back to FIG. 3, when the insert is fully assembled, the first support 32 is sandwiched between the first and second walls 42, 44 of the carrier 36. The planar nature of the components, and the fact that the first and second walls 42, 44 meet at folds, such that the passage 46 between them has negligible depth, means that the first support 32 is substantially in contact with the band 56 and with the second wall 44 of the carrier 36. In this way the insert is slim-line and of negligible depth, such that it can be readily accommodated in an envelope without adding significant depth.

Figure 9:
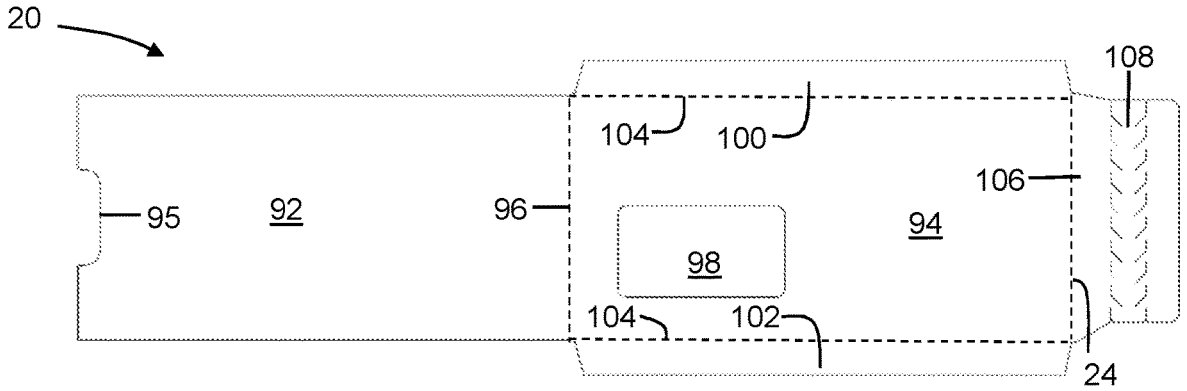
FIG. 9 is a plan view of a sleeve in the form of an envelope, forming part of the package of FIG. 1A, with the sleeve in an unfolded configuration.
Figure 10:
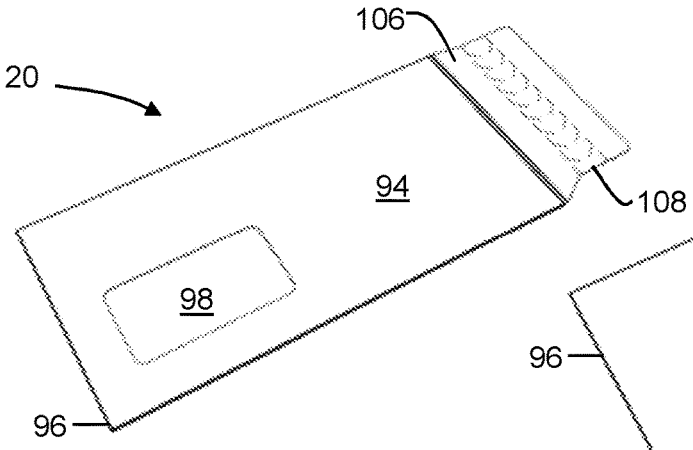
FIGS. 10 and 11 are perspective views of the sleeve of FIG. 9 from above and below respectively, with the sleeve folded for use in the package of FIG. 1A.
Figure 11:
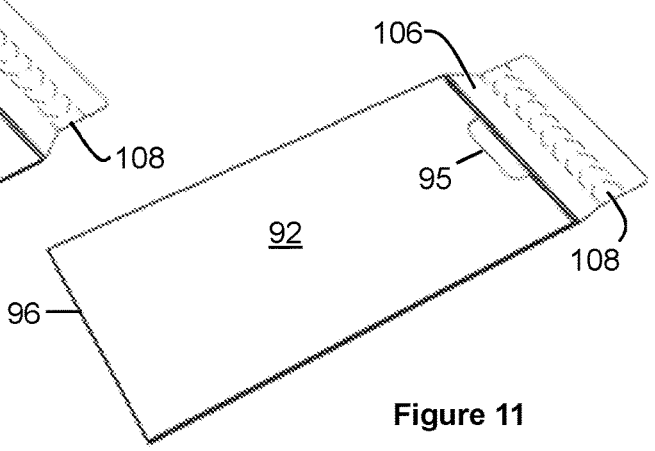

FIGS. 9 to 11 illustrates the envelope 20 in isolation. The envelope 20 is made from a cut or stamped sheet that is formed from a thin flexible material such as paper or card. The envelope is typically a standard size envelope of the type that is frequently used for mailing.

The envelope 20 comprises first and second major panels 92, 94 joined by a fold 96. The first major panel may comprise an address window 98. The second major panel 94 comprises a cut-out 95 that is of substantially the same shape as the cut out 80 in the second wall 44 of the carrier 36.

Upper and lower bonding flaps 100, 102 join the first major panel 92 at folds 104, and in use, when the second major panel 94 is folded over the first major panel 92, the bonding flaps 100, 102 fold over, and are bonded to, the second major panel 94 to secure the second major panel 94 in place. At a second end 24 of the envelope 20, an end flap 106 protrudes from the first major panel. In use, the end flap 106 can be folded over and coupled to the second major panel 94 to close the second end 24 of the envelope 20. The end flap 106 is provided with a tearable portion 108 which can be torn away to open the second end 24 of the envelope 20, thereby allowing access to the contents.

The envelope 20 and insert 30 are designed such that the flat panel 64 that defines the second wall 44 of the carrier 36, and the second support 34 is substantially the same size and shape as the first major panel 92 of the envelope 20. In this way, the footprint of the insert 30 is substantially the same as the foot print of the envelope 20, such that the insert 30 can fit snugly into the envelope 20.

Figure 12:
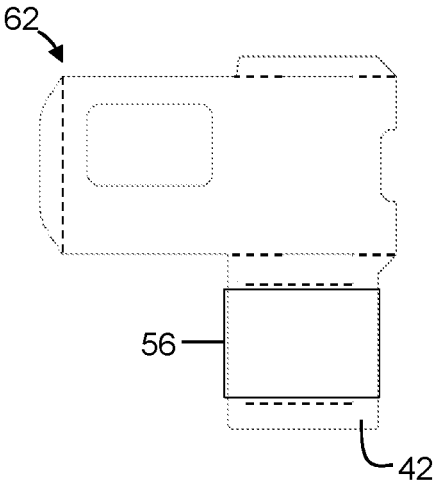
FIGS. 12 to 15 illustrate stages in a process of making the insert of FIG. 5.
Figure 13:
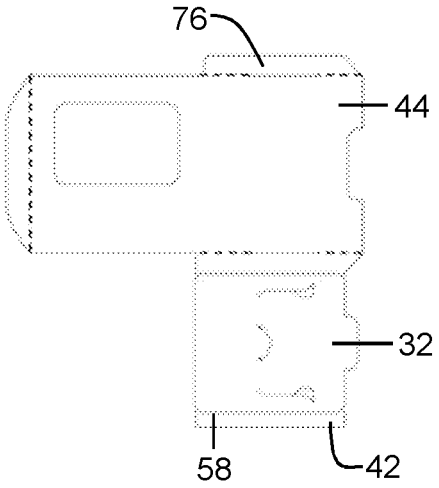
Figure 14:
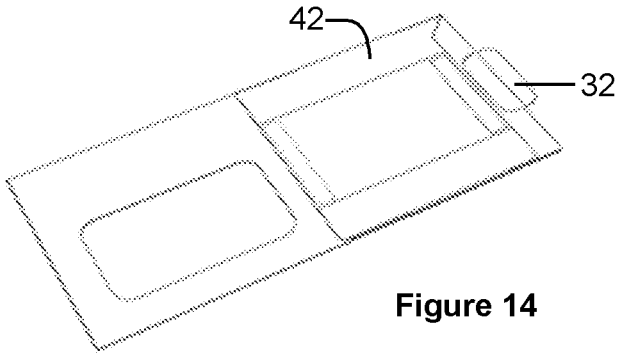
Figure 15:
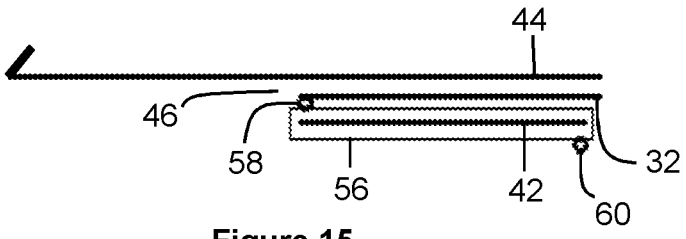

To assemble the insert 30, the component 62 is first provided, and the band 56 is arranged in place around the first wall 42 as shown in FIG. 12. Next, the first support 32 is bonded to the band 56 at the first coupling location 58 as shown in FIG. 13. The first wall 42 of the carrier 36 is then folded over the second wall 44 of the carrier 36, with the first support 32 sandwiched therebetween as shown in FIGS. 14 and 15. This creates the passage 46 between the first and second walls 42, 44, in which the first support 32 is housed. The bonding flap 76 is then folded over and bonded to the first wall 42.

As best seen in FIG. 15, in this configuration, the band 56 is in place on the first wall 42 of the carrier 36, and the first support 32 is housed in the passage 46. One side of the band 56 (the side supporting the first coupling location 58) is shielded by the second wall 44 of the carrier 36, while another side of the band (the side supporting the second coupling location 60), is exposed.

Figure 16:
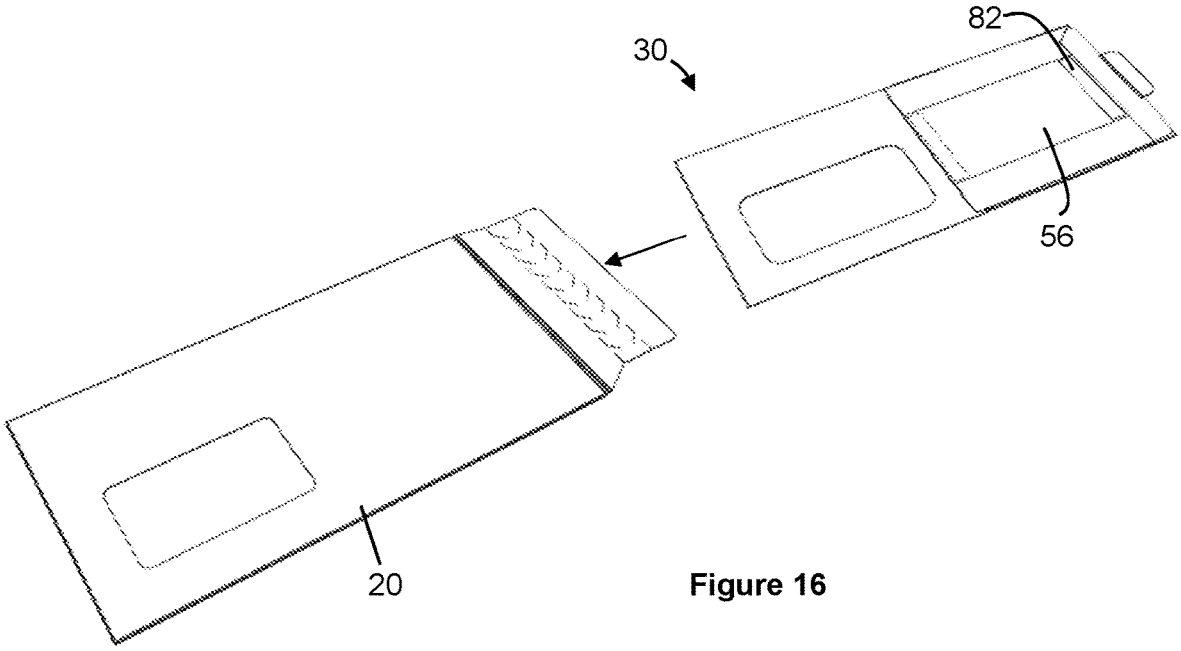
FIGS. 16 to 21 illustrate stages in a process assembling the insert of FIG. 5 and the sleeve of FIGS. 10 and 11 to make a package, and loading the package with articles in the form of a card and a letter.

The insert 30 can then be loaded into an envelope 20 to assemble the package 10. This can be done simply by inserting the insert 30 into the envelope as shown in FIG. 16, and by coupling an internal surface of the envelope 20 to the exposed band 56 at the second coupling location 60. In this example, coupling can be achieved by bonding, using the pre-applied adhesive strip 82 on the band 56.

It will be appreciated that the insert need not be assembled in the same location that the insert is loaded into the envelope. For example, inserts may be assembled at a first location, and may be provided in pre-assembled form to a second location for loading into envelopes.

Figure 17:
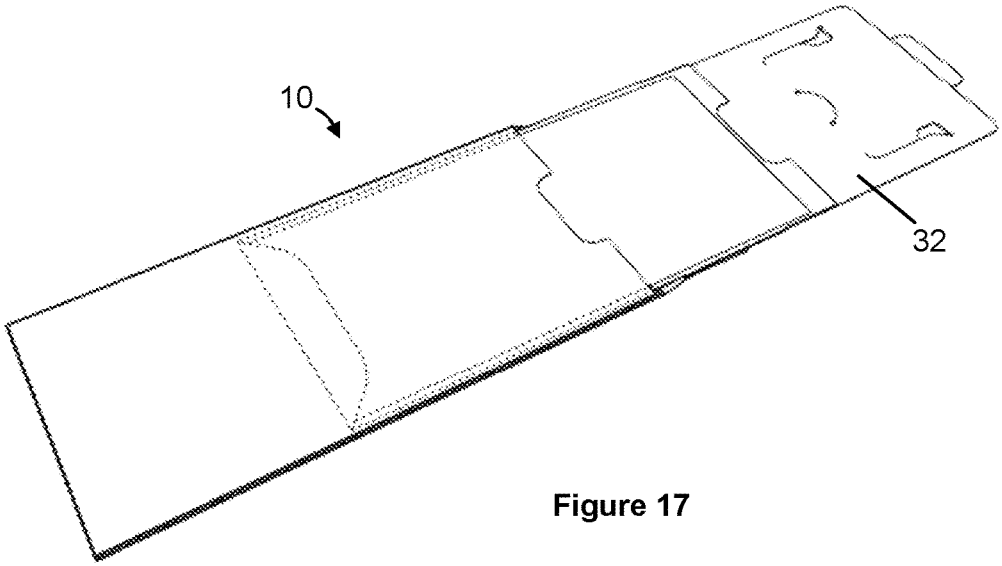
Figure 18:
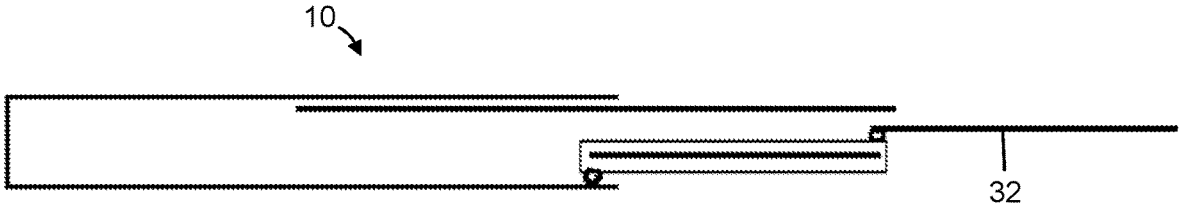
Figure 19:
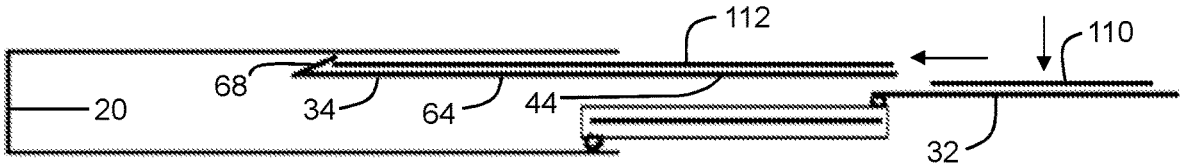

With the package 10 assembled, the contents of the package 10 may then be arranged in place. The package 10 is moved into the extended configuration as shown in FIGS. 17 and 18, so that the first support 32 is exposed. As shown in FIG. 19, a card 110 is arranged in place on the first support 32 by sliding the card 110 into place in the support formations. A letter 112 is then arranged in place on the second support 34 by sliding the letter 112 under the envelope 20, between the flat panel 64 and the lip 68 of the insert 30. In the embodiment shown, the size of the letter 112 is such that the letter 112 extends over both the second support 34 and the second wall 44 of the carrier 36, such that the carrier 36 also has a support function in this example, though it will be appreciated that other letter sizes may be used.

Figure 20:
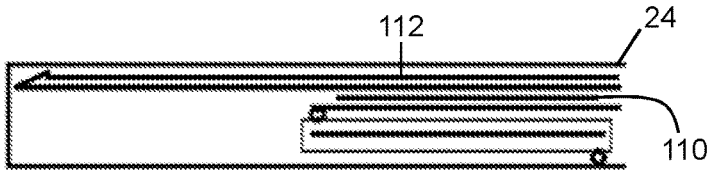
Figure 21:
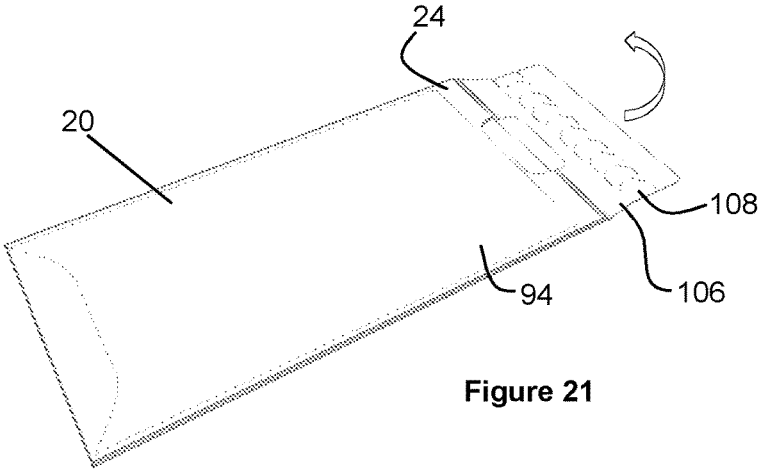

The package 20 is then returned to the retracted configuration as shown in FIG. 20, with the card 110 and letter 112 in place. The second end 24 of the package 20 is sealed by folding the end flap 106 over as shown in FIG. 21, and sealing the end flap 106 to the second major panel 94 of the envelope 20.

Figure 22:
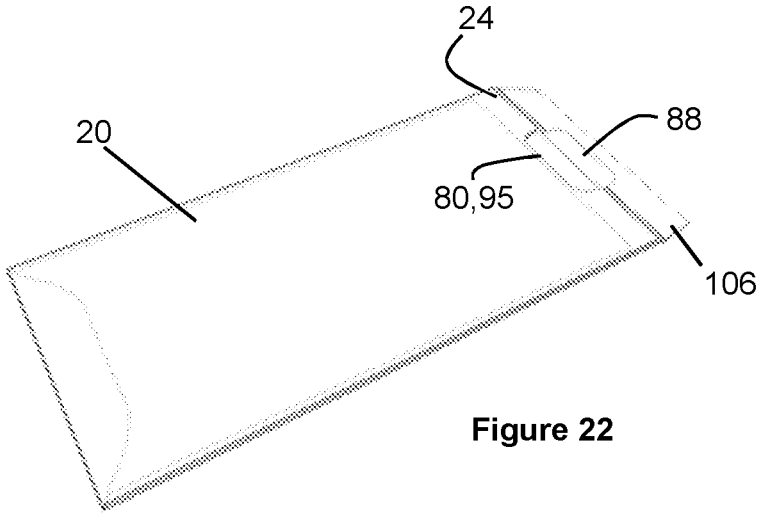
FIGS. 22 and 23 illustrate stages in a process of opening the package and accessing its contents.

To open the package 10 and access the contents, a user first tears the tearable portion 108 of the end flap 106 to open the second end 24 of the envelope 20, as shown in FIG. 22. The user then locates the pull tab 88 that is located within the cut-outs 80, 95 of the envelope 20 and carrier 36, and grips it, thereby unfolding it such that it protrudes from the open end 24 of the envelope 20.

Figure 23:
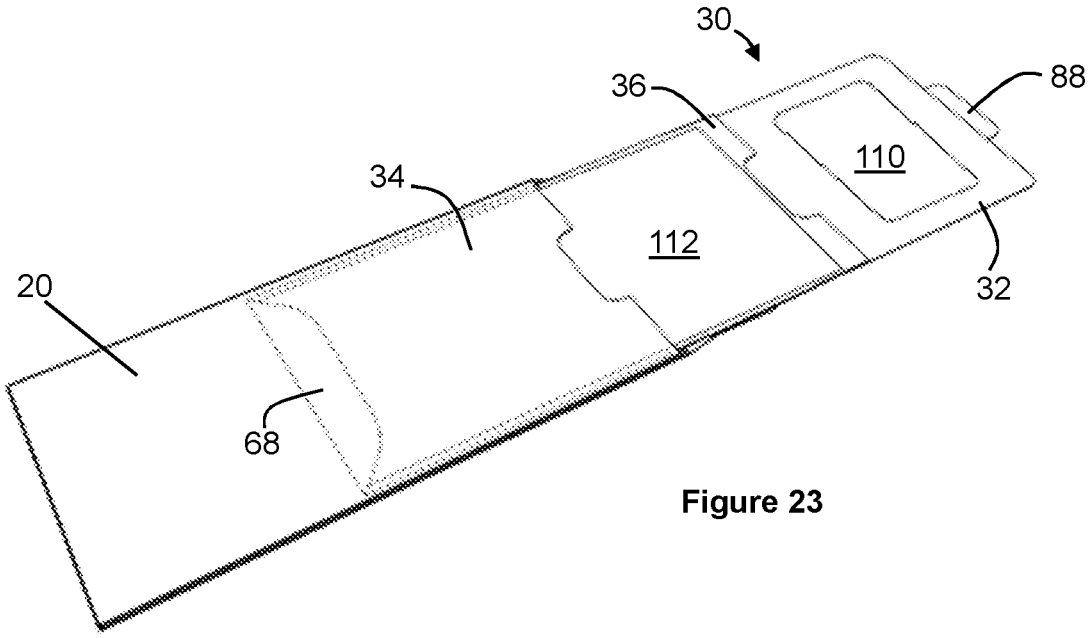

Whilst gripping the envelope 20, the user pulls on the pull tab 88, which drives movement of the band, and hence drives movement of the carrier 36, first support 32 and second support 34 out of the envelope 20 into the extended configuration shown in FIG. 23. As the second support 36 moves, the lip 68 on the second support 34 pushes on the letter, thereby ensuring that the letter is driven out along with the second support 34.

In this configuration, the card supported on the first support 32 is fully revealed for access by the user. A portion of the letter (in this case approximately half of the letter) is also revealed, such that the user can easily grip the letter and extracted it from the envelope 20.

Thus, the insert 30 provides an effective means for supporting articles such as a card 110 and letter 112, which allows both the card 110 and letter 112 to be propelled out of a sleeve, such as an envelope 20, in an interesting and eye-catching way that can surprise and delight a user. The card 110 and letter 112 can be stored in the envelope 20 one-on-top-of-another while the insert 30 is in the retracted configuration, but will be presented next to each other while the insert 30 is in the extended configuration. This arrangement saves space inside the envelope 20, whilst still allowing the card 110 and letter 112 to be presented side by side when the envelope 20 is opened.

The insert 30 can be quickly and easily arranged in any envelope 20, thus allowing standard envelopes 20 to be fitted with the insert 30 to convert the envelope 20 into a package 10.

Once fitted in the envelope 20, the insert 30 is highly flexible, and does not impede flexibility of the envelope 20. This particularly important in order to provide a mailable package, as it allows the envelope 20 to proceed through normal postal processing, which can include significant bending and manipulation of the envelope 20.

Although in the embodiments described above the insert comprises a second member that protrudes beyond the carrier, embodiments are also envisaged in which the second member is omitted. Alternatively, the second member may be integrated completely with the carrier, such that the carrier performs the support function for supporting the second article. In this case, for example, a lip may be provided at an end of the second wall of the carrier, such that the second wall of the carrier may support an article, and the lip at the end of the second wall may drive the second article out of the sleeve as the insert is moved to the extended configuration.

It will be appreciated that the sleeve, and the various components of the insert, may be made of any suitable materials. For a mailable insert and a mailable package, it is preferred that the sleeve and insert are flexible and hence are made of flexible materials; however embodiments are also envisaged in which the package does not necessarily need to be flexible, in which case non-flexible materials may be used.

Although in the embodiments described the package houses articles in the form of a card and a letter, it will be appreciated that the package may house other articles. For example, the package may house an article or combination of articles in the form of a letter, a card such as a bank card or gift card, an information sheet or information card, or any other suitable article.

Other variations and modifications will be apparent to the skilled person without departing from the scope of the appended claims. The scope of the present invention should, therefore, be determined only by the following claims.

The invention claimed is:

1. An insert for a package, the insert being movable between retracted and extended configurations and comprising:

a carrier having first and second walls defining a passage therebetween, the first wall defining an interior surface that faces the passage, and an exterior surface that faces away from the passage;

a band extending around the first wall of the carrier and through the passage; and a first member located inside the passage when the insert is in the retracted configuration and attached to the band at a first coupling location inside the passage;

wherein at least a portion of the band that overlies the exterior surface of the first wall is exposed for attachment to the sleeve of the package at a second coupling location on the exposed portion of the band; and wherein the insert is receivable in a sleeve of the package and the band is coupleable to the sleeve at the second coupling location such that the carrier and the first member are movable between the retracted configuration in which the carrier and the first member are housed in the sleeve, and the extended configuration in which the carrier and the first member protrude from the sleeve, wherein the first member protrudes from the sleeve to a greater extent than the carrier in the extended configuration.

2. The insert of claim 1, wherein the first and second coupling locations are at opposite ends of the carrier when the carrier and the first member are received in the sleeve in the retracted configuration.

3. The insert of claim 2, wherein the second coupling location is at an end of the carrier adjacent to an opening of the package through which the carrier protrudes in the extended configuration, when the carrier and the first member are received in the sleeve in the retracted configuration.

4. The insert of claim 1, wherein the carrier comprises first and/or second edges that join the first and second walls of the carrier, and wherein the carrier comprises at least one slit that extends partially along the first and/or second edge of the carrier.

5. The insert of claim 1, wherein the second wall of the carrier comprises a foldable bonding flap for attaching to the first wall of the carrier.

6. The insert of claim 1, wherein the carrier comprises a folded sheet.

7. The insert of claim 1, wherein the first wall of the carrier comprises grooves that extend at least partially along edges of the band.

8. The insert of claim 1, comprising a second member coupled to the carrier.

9. The insert of claim 8, wherein, when the insert is in the extended configuration, the first member extends beyond a second end of the carrier, and wherein the second member extends from a first end of the carrier opposite the second end.

10. The insert of claim 8, wherein the second member is coupled to and continuous with the second wall of the carrier.

11. The insert of claim 8, wherein an end of the second member comprises a lip arranged to drive an article out of the sleeve when the carrier and the first member are moved from the retracted configuration to the extended configuration.

12. The insert of claim 8, wherein the second member comprises a window arranged to align with a window of the sleeve when the insert is received in the sleeve in use.

13. The insert of claim 1, wherein the band comprises an adhesive strip for attaching the band to the sleeve, the adhesive strip optionally comprising a removable protective cover.

14. The insert of claim 1, further comprising a second member coupled to the carrier, wherein one or more of the carrier, the first member and the second member are substantially planar.

15. The insert of claim 1, further comprising a second member coupled to the carrier, wherein one or more of the carrier, the first member and the second member are formed of a flexible material.

16. The insert of claim 15, wherein one or more of the carrier, the first member and the second member is formed from a sheet having a thickness between about 0.005 and about 2 mm.

17. A package comprising:

a sleeve; and an insert, the insert further comprising:

a carrier having first and second walls defining a passage therebetween, the first wall defining an interior surface that faces the passage, and an exterior surface that faces away from the passage;

a band extending around the first wall of the carrier and through the passage; and a first member located inside the passage when the insert is in the retracted configuration and attached to the band at a first coupling location inside the passage, wherein at least a portion of the band that overlies the exterior surface of the first wall is exposed for attachment to the sleeve of the package at a second coupling location on the exposed portion of the band, the insert being arranged in the sleeve, and the band of the insert being bonded to the sleeve at the second coupling location on the exposed portion of the band, such that the carrier and the first member of the insert are movable between a retracted configuration in which the carrier and the first member are housed in the sleeve, and an extended configuration in which the carrier and the first member protrude from the sleeve, wherein the first member protrudes from the sleeve to a greater extent than the carrier in the extended configuration.

18. The package of claim 17, further comprising a second member of the insert, and a second article supported by the second member, wherein the second member of the insert and the sleeve each comprise a window, and wherein the window of the second member of the insert and the window of the sleeve are aligned when the insert is received in the sleeve and the carrier and the first member are in the retracted configuration, such that information provided on the second article can be viewed through the windows of the second member of the insert and the sleeve.

19. The package of claim 17, wherein the sleeve is an envelope.

20. A method of manufacturing a package, the package comprising an insert and a sleeve, the insert further comprising a carrier having first and second walls defining a passage therebetween, the first wall defining an interior surface the faces the passage, and an exterior surface that faces away from the passage; a band extending around the first wall of the carrier and through the passage; and a first member located inside the passage when the insert is in the retracted configuration and attached to the band at a first coupling location inside the passage, wherein at least a portion of the band that overlies the exterior surface of the first wall is exposed for attachment to the sleeve of the package at a second coupling location on the exposed portion of the band, the method comprising:

arranging the insert in the sleeve; and coupling the insert to the sleeve at a second coupling location on the exposed portion of the band member, such that the carrier and the first member of the insert are movable between a retracted configuration in which the carrier and the first member are housed in the sleeve, and an extended configuration in which the carrier and the first member protrude from the sleeve, wherein the first member protrudes from the sleeve to a greater extent than the carrier in the extended configuration.

* * * * *